US006076870A

United States Patent [19]

Frolov

[11] Patent Number: 6,076,870

[45] **Date of Patent: *Jun. 20, 2000**

[54] MOTORIZED ELECTRIC STRIKE

[75] Inventor: George Frolov, Farmington, Conn.

[73] Assignee: Harrow Products, Inc., Grand Rapids, Mich.

[ * ] Notice: This patent is subject to a terminal disclaimer.

[21] Appl. No.: 09/410,727

[22] Filed: Oct. 1, 1999

Related U.S. Application Data

[63] Continuation of application No. 09/039,690, Mar. 16, 1998, abandoned.

[51] Int. Cl.[7] ..... E05B 15/02

[52] U.S. Cl. ..... 292/341.16; 292/144

[58] Field of Search ..... 292/341.15, 341.16, 292/341.17, 201, 144, 251.5; 70/277, 278, 283

[56] References Cited

U.S. PATENT DOCUMENTS

| | | | |
|---|---|---|---|
| 3,640,560 | 2/1972 | Zawadzki | 292/341.16 |
| 4,170,374 | 10/1979 | Garcia | 292/201 |
| 4,302,039 | 11/1981 | Dukel | 292/341.16 |
| 4,917,425 | 4/1990 | Logas | 292/341.16 |
| 5,018,375 | 5/1991 | Tully | 70/277 |
| 5,083,122 | 1/1992 | Clark | 70/278 |
| 5,421,178 | 6/1995 | Hamel | 70/283 |
| 5,473,236 | 12/1995 | Frolov | 70/277 |
| 5,628,216 | 5/1997 | Qureshi | 70/277 |
| 5,694,798 | 12/1997 | Nunez | 70/277 |

*Primary Examiner*—B. Dayoan
*Assistant Examiner*—Gary Estremsky
*Attorney, Agent, or Firm*—Alix, Yale, Ristas, LLP

[57] ABSTRACT

An electric strike has a pivoting locking member for locking an electric strike in the closed position. The locking member is pivoted between the locked and unlocked positions by a low current motor. A drive pin pivotally engages the locking member. The motor rotates a roll pin threadably engaging the coil faces of a spring mounted to the drive pin. Rotation of the motor compresses or expands the spring to axially move the drive pin and thereby pivot the locking member between the locked and unlocked positions.

20 Claims, 6 Drawing Sheets

MOTORIZED ELECTRIC STRIKE

CROSS-REFERENCE TO RELATED APPLICATIONS

This application is a continuation of application Ser. No. 09/039,690 filed Mar. 16, 1998 now abandoned.

BACKGROUND OF THE INVENTION

This invention relates to the field of door security systems. More specifically, this invention relates to an electric strike for securing a door to a door frame.

Electric strikes for securing hinged or swinging doors are well-known in the field of door security systems. The electric strikes are employed with doors having projectable dead bolts or latch bolts that engage the electric strike. The electric strike can be configured to secure the door alone, or in combination with other conventional security systems. The electric strike typically is mounted to the door frame and defines an opening in the jamb face of the door frame for receiving the latch bolt and/or dead bolt from the lock set mounted to the door. The electric strike further defines an opening in the frame face contiguous with the opening in the jamb face of the door frame. A pivotal keeper on the electric strike selectively closes the opening in the frame face. A bolt, projecting from the edge of the door, engages the electric strike through the opening in the jamb face. Actuation of the electric strike unlocks the keeper. The keeper is then pivotable to uncover or open the frame face opening to allow the bolt to swing therethrough, and thereby allow opening of the door. The keeper is pivoted by the door being pushed, whereby the bolt engages the keeper of the strike.

The lock assembly of a conventional electric strike is commonly operated by a solenoid. The solenoid is typically configured to be spring biased, wherein energization of the solenoid overcomes the biasing force of the spring to either lock or unlock the electric strike. In a first configuration, power must be continuously supplied to the solenoid in order to maintain the electric strike in a locked condition. This configuration requires a relatively high and continuous input of energy and therefore typically requires electrical wiring through the doorway from an electric line source.

Similarly, electric strikes configured to unlock upon energization can also require a continuous supply of energy in order to maintain the lock in an unlocked condition. Therefore, particularly in settings where the door is to remain unlocked for a substantial period of time, such as during a conventional work day, electrical energy must nevertheless be continuously provided to the electric strike. This second configuration also therefore requires interconnection to continuous line current through the door frame.

SUMMARY OF THE INVENTION

Briefly stated, the motorized electric strike in the preferred form employs a low-current motor to transform the electric strike between the locked and unlocked states. The low-current motor allows for the use of an onboard power source, such as batteries, to energize the electric strike. Alternatively, the electric strike can be energized by an associated battery powered lock controller located at the site of the doorway. The electric strike therefore can be installed without requiring any associated wiring through the door frame from a line source in order to energize the electric strike.

The motorized electric strike has a strike frame defining a jamb face opening and a frame face opening contiguous with the jamb face opening. A keeper assembly including a keeper is pivotally mounted to the strike frame. The keeper opens and closes across the frame face opening to allow dead bolts and/or latch bolts to swing through the frame face opening and thereby allow selective access through the secured doorway. The keeper assembly is locked in the closed position by a lock assembly which engages the keeper assembly. The configuration of the keeper and lock assemblies allows for miniaturization as well as robustness of the strike.

The lock assembly is operated by a reversible low-current motor. The lock assembly has a pivoting locking member for engaging the keeper assembly. Actuation of the motor pivotally moves the locking member to thereby lock and unlock the keeper assembly. The motor is coupled to the locking member to drive the locking member between the locked and unlocked positions. The motor rotates a motor post having a transversely oriented roll pin.

A coiled drive spring encircles the motor post and is mounted to the drive pin which is pivotally engaged with the locking member. The roll pin extends through the coils of the drive spring whereby rotation of the motor post by the motor threadably engages the roll pin against the coils of the drive spring. The threading engagement of the roll pin and the coils of the drive spring pivots the locking member between the locked and unlocked positions. The coiled drive spring allows for deliberate over-rotation of the motor in either the locked direction or unlocked direction to thereby fully pivot the locking member between the locked and unlocked positions. Any over-rotation of the motor in either rotational direction merely results in longitudinal contraction or expansion of the drive spring.

The motorized electric strike has very favorable low power requirements since electrical current is only applied to the motor during the actual locking and unlocking of the electric strike. No continuous electrical power is required to maintain the electric strike in either the locked position or the unlocked position. Therefore, the electric strike can be powered by a lock controller having an onboard power source, such as batteries, thereby eliminating the requirement of line current to power the electric strike.

An object of the invention is to provide a new, improved and relatively compact electric strike for selectively controlling access through a doorway.

Another object of the invention is to provide a motorized electric strike that can be maintained in the locked or unlocked state without a continuous application of current to the electric strike.

A further object of the invention is to provide a motorized electric strike requiring a low power consumption whereby the strike can be powered by an onboard or associated battery source.

These and other objects of the invention will become apparent from a review of the specification and the drawings.

DESCRIPTION OF THE PREFERRED EMBODIMENT

Figure 5:
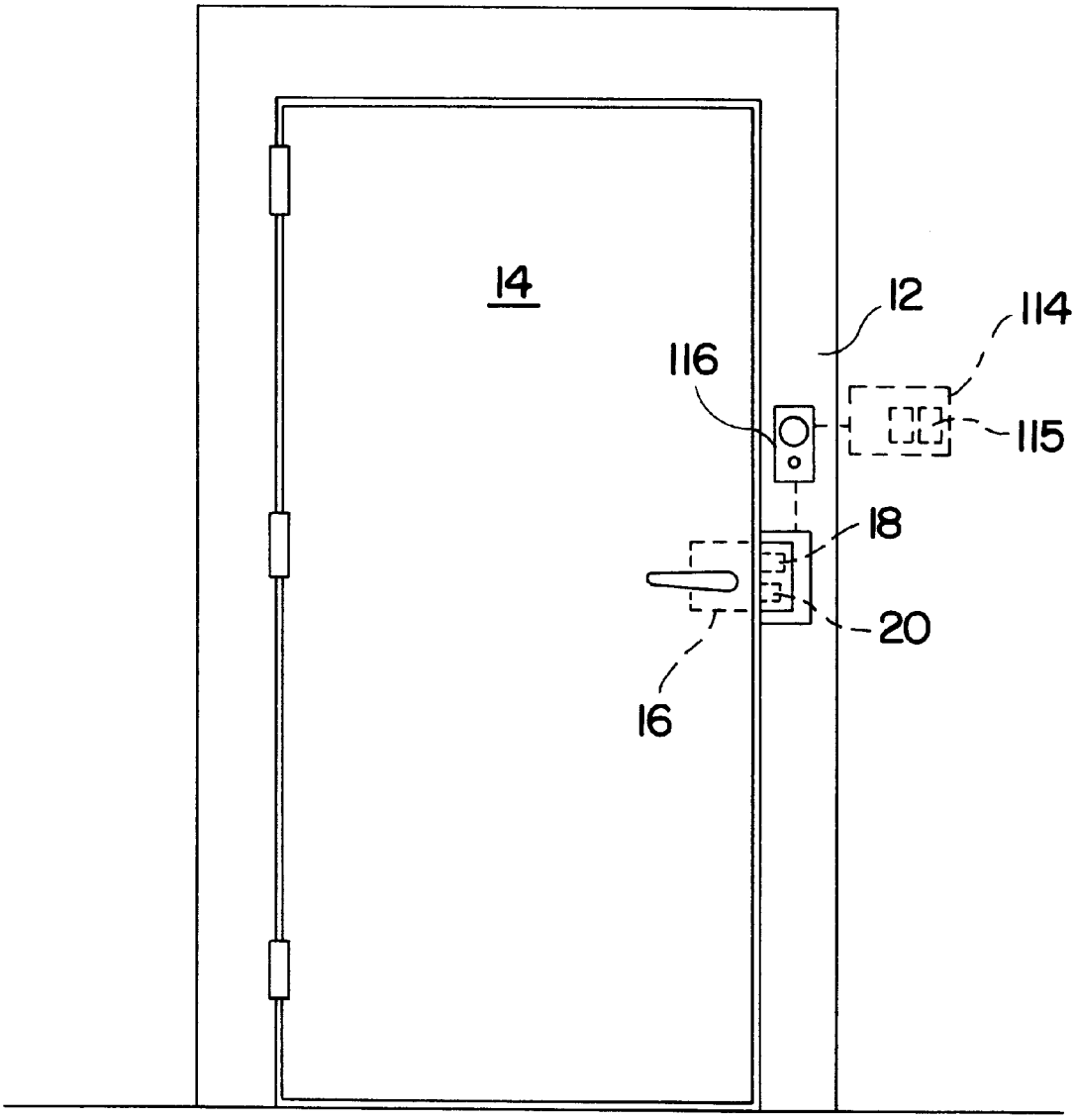
FIG. 5 is a front view of the electric strike of FIG. 1 in combination with a code reader, a lock controller, illustrated in phantom, a door having a lock set, illustrated in phantom, and a supporting door frame.
Figure 6:
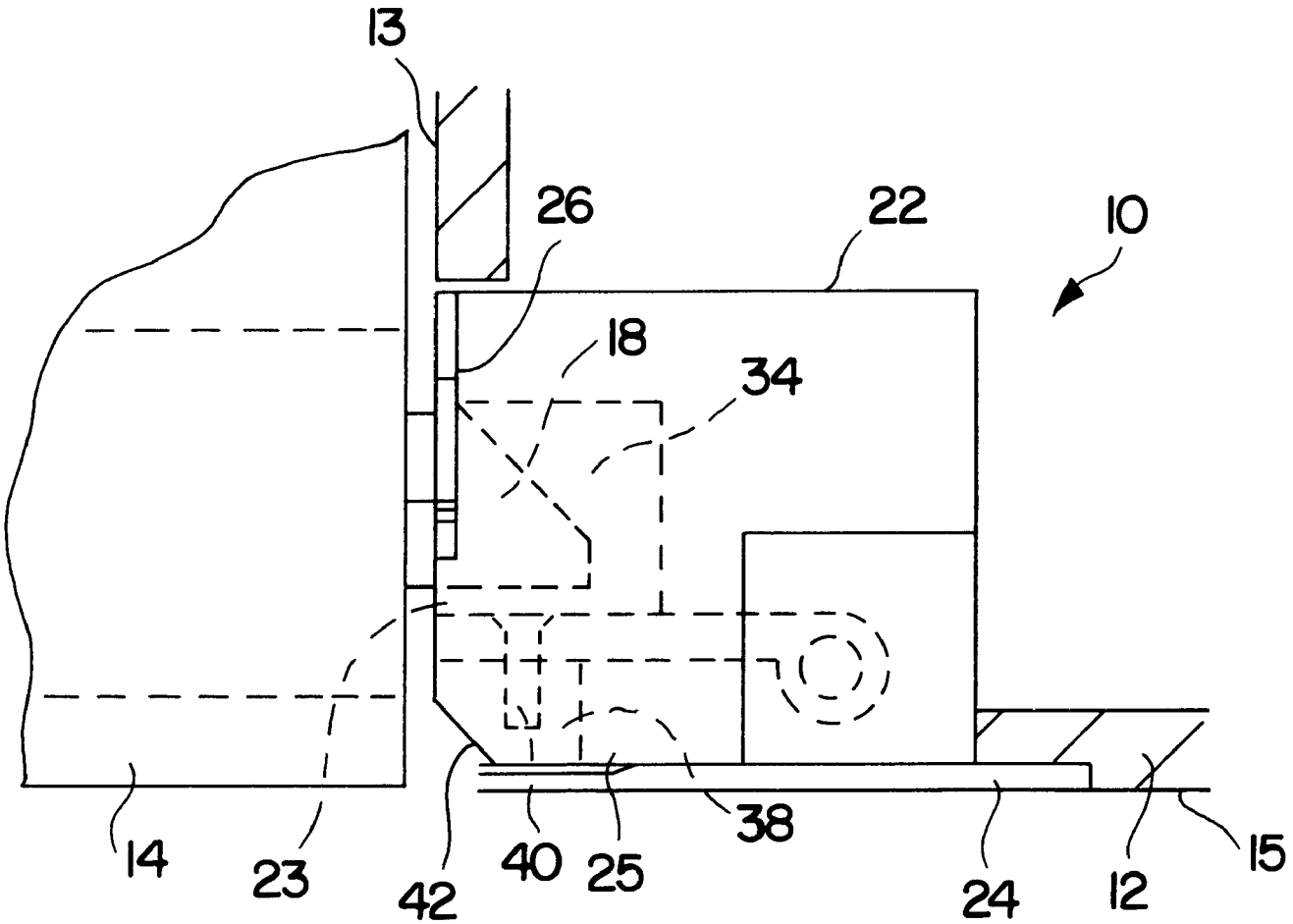
FIG. 6 is an enlarged fragmentary top view, partially in phantom, of the electric strike door and frame of FIG. 5.

With reference to the drawings wherein like numerals represent like parts, a motorized electric strike is generally designated by the numeral 10. With reference to a preferred application illustrated in FIGS. 5 and 6, the electric strike 10 in accordance with the invention selectively secures a door 14 to a door frame 12 to provide controlled access through a doorway. The electric strike 10 is mounted to the vertical edge of the door frame 12. The electric strike 10 can preferably without modification be readily mounted to either vertical side of the door frame 12 for either left or right opening doors. The door 14 has conventional lock hardware including a latch set 16 having a beveled latch bolt 18 and a dead bolt 20 extending from the door edge for engagement with the electric strike 10. The electric strike 10 is positioned in a corner cut out through the frame face 15 and jamb face 13 of the door frame 12.

Figure 1:
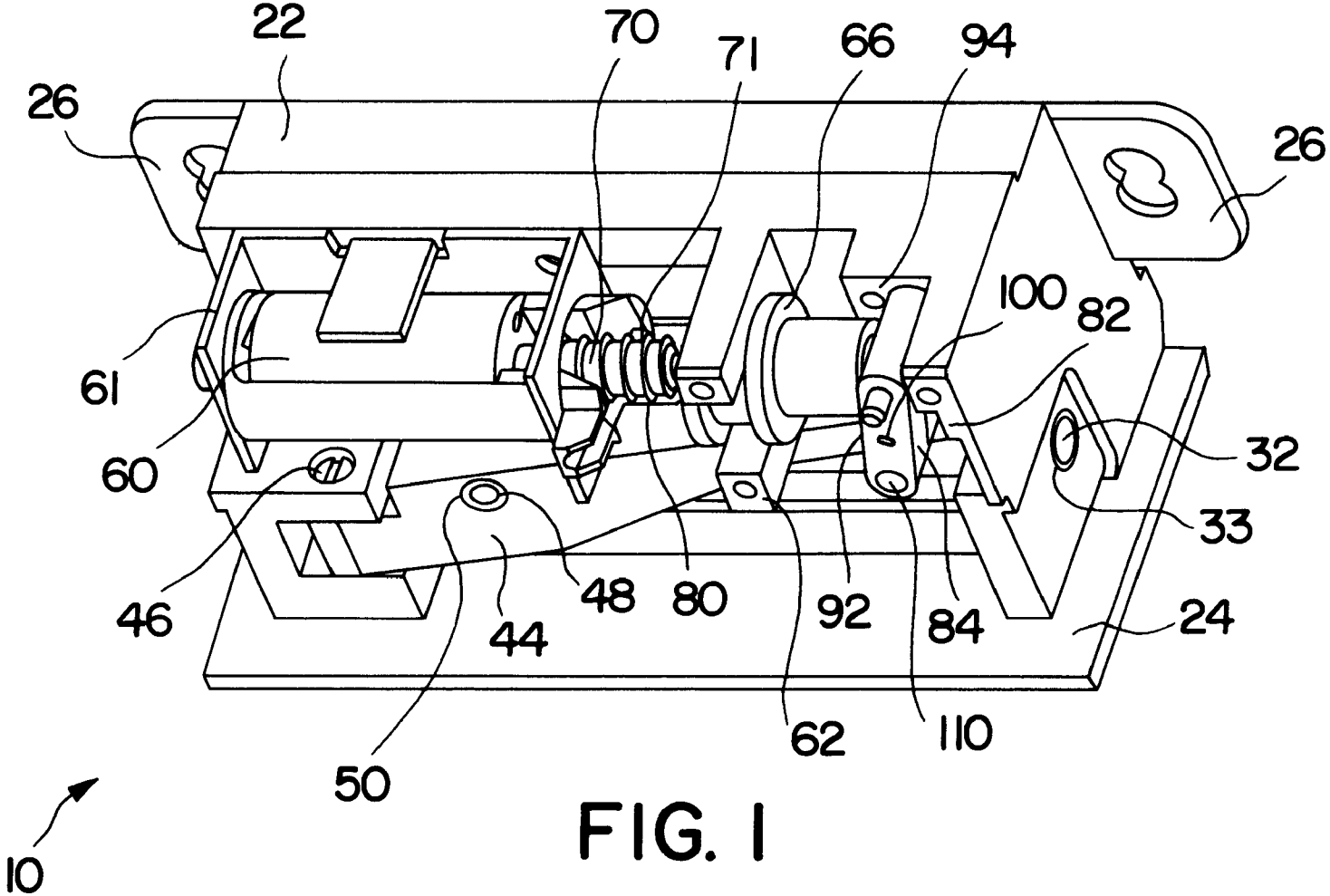
FIG. 1 is a perspective view, housing portions removed, of an electric strike in accordance with the invention.
Figure 2:
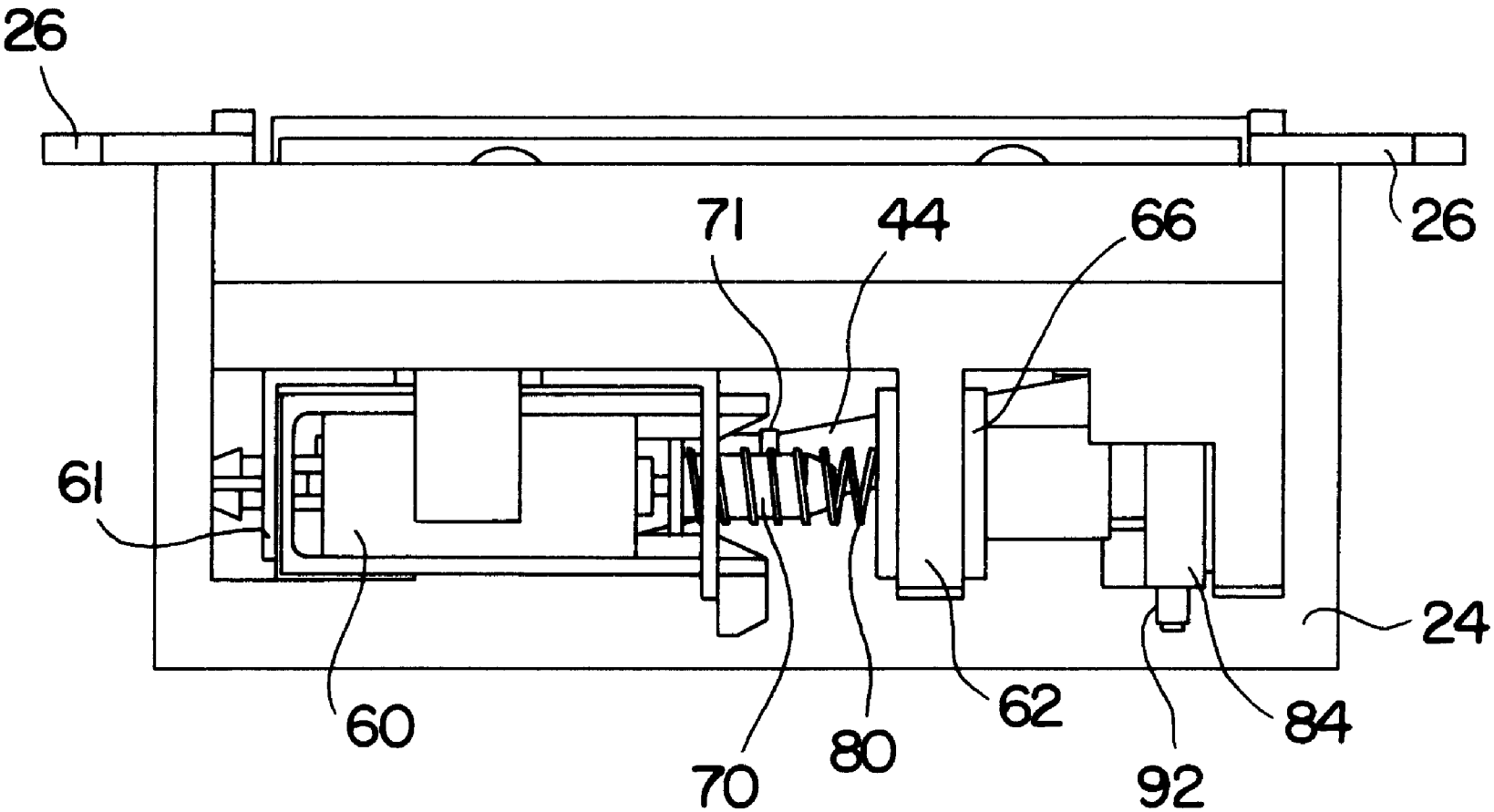
FIG. 2 is a top plan view of the electric strike of FIG. 1.
Figure 3:
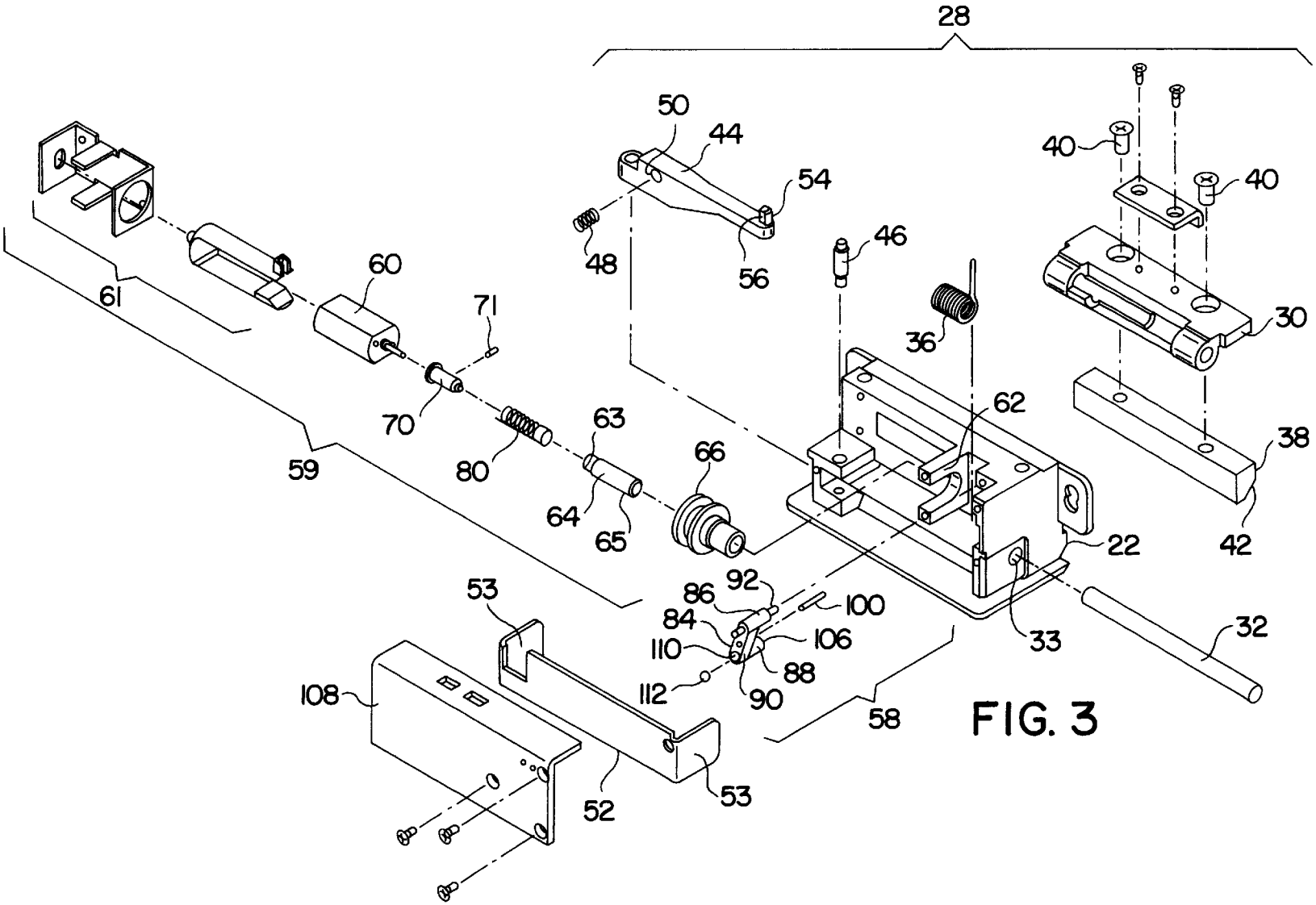
FIG. 3 is an exploded rear perspective view of the electric strike of FIG. 1, including housing covers.
Figure 4:
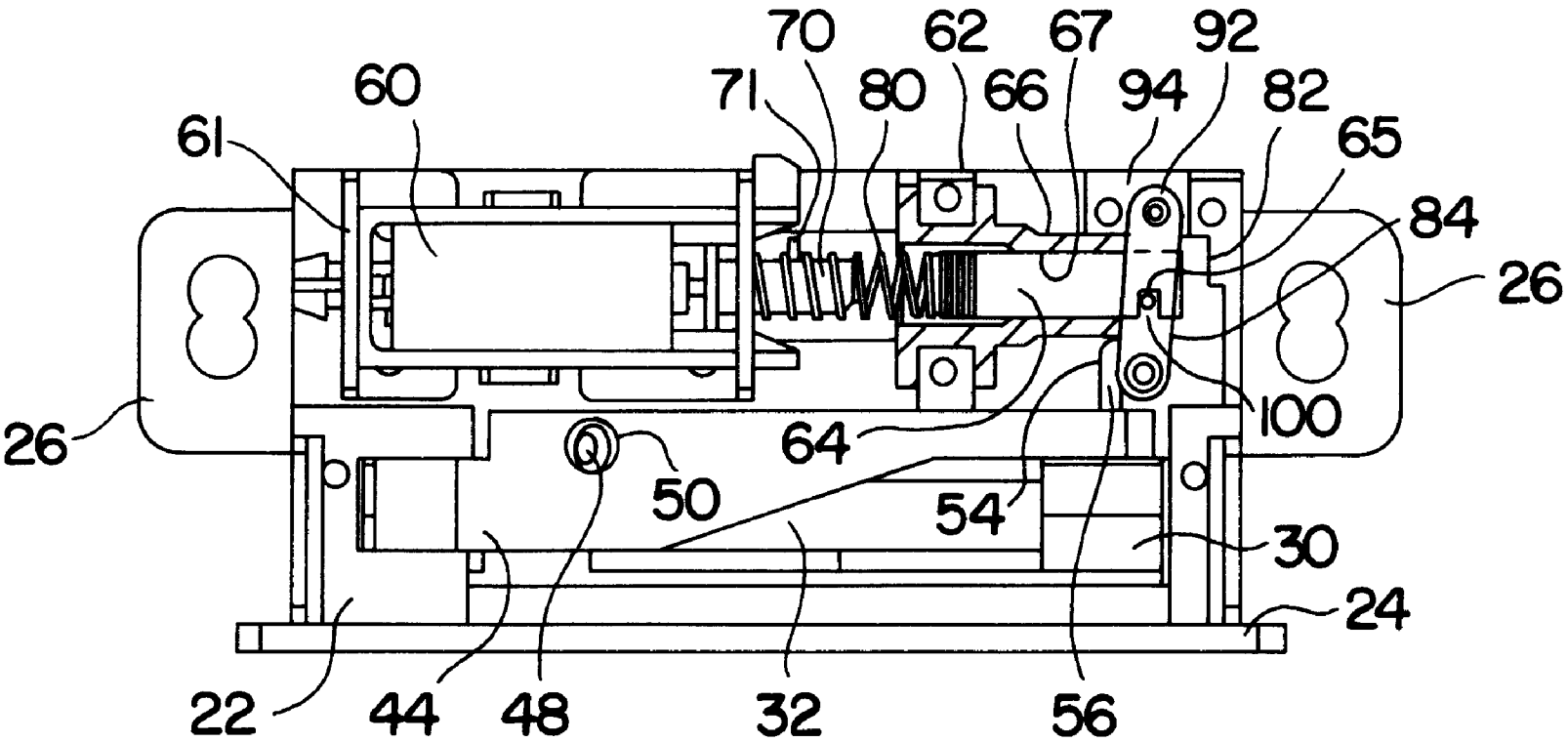
FIG. 4 is a partial cross-sectional side elevational view of the electric strike of FIG. 1.

With additional reference to FIGS. 1–3, the electric strike 10 has a strike frame 22 which constitutes the principal support structure. The strike frame 22 defines a jamb face opening 23 oriented toward the door 14 and generally coplanar with the jamb face 13 of the door frame 12. The strike frame 22 further defines a frame face opening 25 generally orthogonal to jamb face opening 23 and coplanar with the frame face 15 of the door frame 12. The jamb face opening 23 and frame face opening 25 are contiguous to form a lock cavity whereby the bolts 18, 20 of the latch set 16 can swing therethrough to allow opening of the door 14. A frame face flange 24 extends laterally and longitudinally from the strike frame 22 for extension along the frame face 15 of the door frame 12. A pair of opposed coplanar mounting tabs 26 extend longitudinally from the strike frame 22. The mounting tabs 26 receive fasteners (not shown) to mount the electric strike 10 to the jamb face 13 of the door frame 12.

A keeper assembly 28 is mounted to the strike frame 22. The keeper assembly 28 has a keeper 30 pivotally mounted to the strike frame 22 by a longitudinally oriented keeper pin 32. The strike frame 22 defines a keeper pin opening 33 for receiving the keeper pin 32. The keeper assembly 28 selectively closes across the frame face opening 25. The strike frame 22, in combination with the keeper 30 in the closed position, together define a bolt receiving cavity 34. (See FIG. 6.) The bolt receiving cavity 34 receives the extended bolts 18, 20 of the latch set 16. The keeper 30 pivots between a closed position across the frame face opening 25 and an open position whereby the bolts 18, 20 can swing through the frame face opening 25. A torsion keeper spring 36 surrounding the keeper pin 32 biases the keeper 30 to the closed position. The keeper spring 36 has a first end engaged with the keeper 30 and an opposite second end engaged with the strike frame 22.

A longitudinally oriented keeper face member 38 is mounted by screws 40 to the keeper 30. The keeper face member 38 defines a beveled face 42 for engaging the beveled latch bolt 18. The beveled face of the latch bolt 18 is engageable with the beveled face 42 of the keeper face member 38. As the door 14 is closed, the latch bolt 18 is driven inward by the engagement with the beveled face 42 of the keeper face member 38 to allow full closure of the door 14 when the keeper 30 is in the closed position and the door 14 is swung closed thereon.

The keeper assembly 28 further has a retaining arm 44. The retaining arm 44 is pivotally mounted to the strike frame 22 and is in camming engagement with the keeper 30. A retaining arm pin 46 threadably engages the strike frame 22 to support the retaining arm 44 on to the strike frame 22. The retaining arm 44 has an axis of rotation generally orthogonal to the axis of rotation of the keeper 30, and the returning arm 44 is further positioned longitudinally in the strike frame 22 generally parallel to the keeper 30.

A compression retaining arm spring 48 is positioned within a spring opening 50 in the retaining arm 44. The retaining arm spring 48 biases the retaining arm 44 against the keeper 30. The retaining arm spring 48 is maintained in compression between the retaining arm 44 and a lower housing cover 52. The lower housing cover 52 forms a rear plate against which the retaining arm spring 48 engages. The lower housing cover 52 further has transversely extending panels 53 that cover the ends of the keeper pin opening 33 into which the keeper pin 32 is inserted. The engagement of the panels 53 over the keeper pin opening 33 maintains the keeper pin 32 in longitudinal position.

In operation, the keeper 30 is biased to the closed position by the keeper spring 36. The retaining arm 44 is maintained in a first position against the keeper 30 by the retaining arm spring 48. A door user pushing on the door 14 drives the bolts 18, 20 to engage the keeper 30. The keeper 30 is thereby driven to the opened position. The camming engagement of the keeper 30 and the retaining arm 44 interact to pivot the retaining arm 44 outward against the biasing force of the retaining arm spring 48 when the keeper 30 is driven from the closed position to the opened position. The retaining arm 44 thereby pivots to a second position when the keeper 30 pivots to the open position. The keeper 30 is returned to the closed position by the biasing force of the keeper spring 36 once the bolts 18, 20 clear the keeper 30. The retaining arm 44 pivotally returns from the second position to the first position under the biasing force of the retaining arm spring 48.

The distal end portion of the retaining arm 44 supports an orthogonally oriented locking pin 54. The locking pin 54 defines an arm engagement surface 56 for engagement by a lock assembly 58 to lock the keeper 30 in the closed position. The lock assembly 58 engages the locking pin 54 and the retaining arm 44 to lock the retaining arm 44 in the first position. Locking the retaining arm 44 in the first position locks the keeper 30 in the closed position due to the camming engagement of the retaining arm 44 and the keeper 30. The lock assembly 58 has a lock drive assembly 59 having a low-current reversible motor 60. The lock drive assembly requires minimal electrical energy to operate and thereby lock and unlock the keeper assembly 28. The motor 60 is mounted longitudinally in the electric strike by a motor mount assembly 61.

The strike frame 22 further defines a U-shaped support cradle 62. Mounted on the support cradle 62 is a generally tubular drive pin bushing 66 defining a longitudinally oriented bushing throughbore 67. A drive pin 64 is positioned in the bushing throughbore 67 and slidably engages the drive pin bushing 66. A longitudinally oriented motor post 70 is fixed to the end of the motor 60 for rotation thereby. The motor post 70 and drive pin 64 are generally axially aligned. The motor post 70 supports a transversely oriented roll pin 74. A coil drive spring 80 has one end portion slidably surrounding the motor post 70 and the opposite end portion engaged to the drive pin 64. The drive spring 80 fixedly threadably engages a threaded end portion 63 of the drive pin 64. The distal end portion of the roll pin 71 extends between the coils of the drive spring 80. Rotation of the motor post 70 by the motor 60 threadably engages the roll pin 71 against the coil faces of the drive spring 80. The sliding engagement of the roll pin 71 against the helical coil faces of the drive spring 80 thereby tensions or compresses the drive spring 80 sufficiently to slide the drive pin 64 longitudinally within the drive pin bushing 66. Rotation of the motor 60 in opposite rotational directions thereby retracts and extends the drive pin 64 to thereby pivot the lock assembly 58. The stretching of the drive spring 80, in compression or tension, allows the motor 60 to consistently over rotate or under rotate without damaging the lock assembly 58, while forcing the drive pin 64 to a fully extended or retracted position.

The extended position of the drive pin 64 is defined by a stop 82 on the strike frame 22. The lock assembly 58 further has a pivoting locking member 84 pivotally mounted to the strike frame 22. The locking member 84 has an axis of rotation generally orthogonal to the axes of rotation of the keeper 30 and retaining arm 44. A drive pivot pin 100 extends from the lock member 84 to pivotally engage a drive pin slot 65 in the drive pin 64. The locking member 84 has a generally U-shaped configuration with a pivoting arm 86 and spaced parallel engagement arm 88. The pivoting arm 86 and engagement arm 88 are interconnected by a base portion 90. The pivoting arm 86 defines a through bore 87 for receiving a mount pivot pin 92. The mount pivot pin 92 extends into a locking member mount 94 defined by the strike frame 22. The lock member mount 94 defines a mount opening 96 for receiving the mount pivot pin 92.

The drive pivot pin 100 extends from the base portion 90 of the locking member 84 and is oriented generally parallel to the mount pivot pin 92. The end portion of the engagement arm 88 of the locking member 84 defines a lock engagement surface 106 for engagement to the arm engagement surface 56 of the locking pin 54.

The locking member 84 is maintained in transverse position by an upper housing cover 108 mounted to the strike frame 22. The locking member 84 further preferably defines a spherical indent 110 to support a ball bearing 112 opposite the lock engagement surface 106. The ball bearing 112 rollingly engages the inside surface of the upper housing cover 108 to allow smooth pivoting motion of the locking member 84.

The lock assembly 58 operates to lock the keeper assembly 28 in the closed position. More particularly, the motor 60 via the drive spring 80 and drive pin 64 pivots the locking member 84 on the mount pivot pin 92 whereby the lock engagement surface 106 is positioned to be engaged to arm engagement surface 56 of the lock pin 54 when the retaining arm 44 is in the first position. The engagement of the lock assembly 58 with the lock pin 54 prevents the retaining arm 44 from pivoting to the second position. The camming relationship between the retaining arm 44 and keeper 30 is configured such that when the retaining arm 44 is maintained in the first position by the lock assembly 58, the keeper 30 cannot be rotated from the closed to the opened position. Therefore, the keeper assembly 28 is accordingly locked by the engagement of the lock assembly 58 with the lock pin 54.

The electric strike 10 is preferably controlled by a lock controller 114 having an associated code reader 116. (See FIG. 5) The code reader 116 can be a key pad, a card reader, an electronic touch entry device or other well known coder reading devices. The lock controller 114 is wall or door frame mounted on the secure side of the door 14 to prevent tampering by unauthorized personnel. The code reader 116 is mounted on the controlled side of the door 14 and is connected to the electric strike 10 and lock controller 114 by concealed wiring. The lock controller 114 preferably is powered by an onboard power source such as batteries 115. The batteries 115 power the lock controller 114, the code reader 116 and the electric strike 10. Alternately, the electric strike 10 itself can have an onboard power source such as batteries (not shown). The lock controller 14 operates in a well known manner to receive codes from the code reader 116 and further operates the electric strike 10 in response to the entered codes.

While preferred embodiments of the present invention have been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What is claimed:

1. An electrically controlled strike for securing a door to a frame comprising:

a strike frame including a frame face defining a frame face opening and a jamb face defining a jamb face opening;

a keeper assembly comprising a keeper pivotally mounted in a first axis to said strike frame, said keeper having a closed position across said frame face opening and an opened position to open said frame face opening, said strike frame and said keeper defining a bolt receiving cavity and a retaining arm engaging said keeper, said retaining arm including a first end portion mounted to said strike frame in a second pivotal axis, said second axis intersecting said frame face and generally orthogonal to said first axis and an opposing second end portion;

a keeper spring for biasing said keeper to the closed position; and a lock assembly engaging said keeper assembly for selectively locking said keeper in said closed position, said lock assembly comprising, an actuator assembly comprising a motor capable of rotation and a drive pin, said drive pin having a first pin position and a second pin position, whereby the motor rotation moves said drive pin between said first pin position and said second pin position, and a locking member defining a locking surface engageable with said keeper assembly to lock said keeper in said closed position, said locking member pivotally engaged to said strike frame in a third axis generally orthogonal to said first and second axes wherein said locking surface engages said keeper assembly to lock the keeper in the closed position when said drive pin is in said first pin position and release said keeper assembly when said drive pin is in said second pin position.

2. The strike of claim 1 wherein said actuator assembly comprises a spring coupling said motor and said drive pin, and rotation of said motor moves said drive pin between said first and second pin positions.

3. The strike of claim 2 wherein said drive pin is linearly moveable between said first and second pin positions, said linear movement being substantially parallel to said first axis.

4. The strike of claim 2 wherein said coupling spring is a coil spring and rotation of said motor expands and compresses said coupling spring to drive said drive pin between said first and second pin positions.

5. The strike of claim 2 wherein said coupling spring is a coil spring having coil faces and said motor rotates a roll pin slidably engaging said coil faces to drive said drive pin between said first and second pin positions.

6. The strike of claim 1 wherein said locking member has a first end portion and a spaced second end portion, a first coupler mounted to said first end portion for said pivotal engagement with said strike frame, said second end portion defining said locking surface, and a second coupler positioned between said first end portion and said second end portion for engagement with said drive pin.

7. The strike of claim 6 wherein said locking member first end portion, said second end portion and said second coupler are all substantially parallel to said third axis.

8. The strike of claim 6 wherein said first coupler comprises a first pivot pin and said second coupler comprises a second pivot pin.

9. The strike of claim 1 wherein, said retaining arm defines a first arm position and a second arm position, said keeper moving said retaining arm from said first arm position to said second arm position when said keeper moves from said closed position to said opened position, said retaining arm locking said keeper in said closed position when said retaining arm is locked in said first position, said retaining arm adjacent said second end comprising an arm engagement surface engageable to said locking surface of said locking member to lock said keeper in the closed position.

10. The strike of claim 9 wherein said retaining arm engagement surface comprises a projection substantially parallel to said second axis.

11. An electrically controlled strike for securing a door to a door frame comprising:

a strike frame including a frame face defining a frame face opening and a jamb face defining a jamb face opening;

a keeper assembly comprising a keeper pivotally mounted in a first axis to said strike frame, said keeper having a closed position across said frame face opening and an opened position to open said frame face opening, said keeper assembly further comprising a retaining arm pivotably mounted in a second axis intersecting said frame face and substantially orthogonal to said first axis, said retaining arm engageable with said keeper, said retaining arm having a first arm position when said keeper is in said closed position and a second arm position when said keeper is in said opened position, said keeper pivoting said retaining arm in a first plane of motion parallel to said first axis between said first arm position and said second arm position when said keeper pivots between said closed position and said opened position, said retaining arm locking said keeper in said closed position when said retaining arm is locked in said first arm position, said strike frame and said keeper defining a bolt receiving cavity; and a lock assembly for selectively locking said keeper in said closed position, said lock assembly comprising a locking member for locking said retaining arm in said first arm position, said locking member having a lock pivot defining a third axis substantially orthogonal to said first and second axes and pivotable in a second plane of motion substantially orthogonal to said first plane of motion between a first lock position wherein said retaining arm is locked in said first arm position and a second lock position wherein said retaining arm is pivotable to said second arm position and an actuator assembly comprising a motor rotatably drivable to pivot said locking member between said first and said second lock positions.

12. The strike of claim 11 further comprising a door frame, the strike frame mounted thereto wherein said frame face is generally orthogonal to a jamb face of said door frame and coplanar with a frame face of said door frame.

13. The electric strike of claim 11 wherein said third axis intersects said strike jamb face.

14. The electric strike of claim 11, wherein:

a first end of said retaining arm is pivotably mounted to said strike frame and an opposing second end defines an engagement surface; and said locking member comprises a locking surface spaced from said lock pivot and engageable with said retaining arm engagement surface in said first arm position.

15. The electric strike of claim 11 wherein said strike frame comprises a U shaped cradle and a bushing is removably supported within said cradle, said drive pin being slidably received in said bushing.

16. A door security system comprising:

a door frame comprising a frame face and a jamb face having a door pivotally mounted to a first door frame side; and an electrically actuated strike fixedly mounted to an opposing second door frame side, said strike comprising, a generally rectangular strike frame comprising a frame face defining a frame face opening, a jamb face coplanar with said door frame jamb face and defining a jamb face opening and spaced opposing first and second ends intersecting said strike frame jamb and frame faces, a keeper assembly comprising a keeper pivotally mounted in a first axis to both said strike frame ends, said keeper having a closed position across said frame face opening and an opened position to open said frame face opening, a retaining arm engaging said keeper, said retaining arm including a first end portion mounted to said strike frame in a second pivotal axis for movement in a plane parallel to said first axis, said second pivotal axis intersecting said strike frame face and substantially orthogonal to said first axis, and an opposing second end portion, and a lock assembly comprising, an actuator assembly comprising a rotatable motor, a drive pin and a spring coupling said motor to said drive pin, said drive pin having a first pin position and a second pin position, whereby the motor rotation moves said drive pin linearly between said first pin position and said second pin position, and a locking member comprising a first end defining a locking surface engageable with said retaining arm to lock said keeper in said closed position and a spaced second end defining a coupler pivotally engaged to said strike frame in a third axis substantially orthogonal to said first and second axes wherein said locking surface engages said retaining arm toward said second end to lock the keeper in the closed position when said drive pin is in said first pin position and release said keeper when said drive pin is in said second pin position.

17. The door security system of claim 16 wherein said retaining arm adjacent said second end comprises a projection orthogonal to said plane of movement and substantially parallel to said second axis.

18. The door security system of claim 16 wherein said retaining arm is mounted adjacent a first strike frame end and said locking member is mounted adjacent an opposing said strike frame end.

19. The door security system of claim 16 wherein said locking member locking surface engages said retaining arm projection in said first pin position.

20. The door security system of claim 16 comprising lock controller means for actuating said strike, said lock controller means mounted adjacent said door frame and having an onboard power supply; and a code reader operably connected to said lock controller means.

* * * * *